US007091856B2

(12) United States Patent
Tibi et al.

(10) Patent No.: US 7,091,856 B2
(45) Date of Patent: Aug. 15, 2006

(54) MONITORING ACCESS VIA A PASSAGE

(75) Inventors: Dov Tibi, Givat Ella (IL); David Fisher, Kiryat Ata (IL)

(73) Assignee: Rafael Armament Development Authority, Ltd., Haifa (IL)

( * ) Notice: Subject to any disclaimer, the term of this patent is extended or adjusted under 35 U.S.C. 154(b) by 0 days.

(21) Appl. No.: 11/093,788

(22) Filed: Mar. 29, 2005

(65) Prior Publication Data

US 2006/0061450 A1 Mar. 23, 2006

(30) Foreign Application Priority Data

Mar. 30, 2004 (IL) ..... 161183

(51) Int. Cl.
*G08B 13/00* (2006.01)

(52) U.S. Cl. ..... 340/541; 340/551; 340/552; 340/572.1

(58) Field of Classification Search ..... 340/541, 340/551, 552, 572.1
See application file for complete search history.

(56) References Cited

U.S. PATENT DOCUMENTS

| | | | | |
|---|---|---|---|---|
| 4,586,441 | A | 5/1986 | Zekich | |
| 5,400,722 | A | 3/1995 | Moses et al. | |
| 5,600,303 | A * | 2/1997 | Husseiny et al. | 340/568.1 |
| 5,615,622 | A | 4/1997 | Moses et al. | |
| 6,742,301 | B1 | 6/2004 | Schwarz | |
| 2003/0136052 | A1 | 7/2003 | De Boer | |
| 2004/0098237 | A1 * | 5/2004 | Pendergraft et al. | 703/7 |
| 2004/0124982 | A1 * | 7/2004 | Kovach | 340/572.1 |
| 2004/0252024 | A1 * | 12/2004 | Huey et al. | 340/540 |
| 2005/0065834 | A1 * | 3/2005 | Hale et al. | 705/8 |

FOREIGN PATENT DOCUMENTS

| | | |
|---|---|---|
| EP | 0 599 291 A | 6/1994 |
| EP | 1 256 908 A | 11/2002 |

OTHER PUBLICATIONS

Related U.S. Appl. No. 11,026,384, filed Dec. 30, 2004; in the name of David Fisher; entitled Facility and Method for Crowd Screening and Protection.

* cited by examiner

*Primary Examiner*—Daniel Wu
*Assistant Examiner*—Samuel J. Walk
(74) *Attorney, Agent, or Firm*—Frishauf, Holtz, Goodman & Chick, P.C.

(57) ABSTRACT

A method and a system for monitoring access of a person from an exterior to an interior of a partition via a passage having an openable closed opening, using a detection device and supervision of an operator. A monitoring unit is coupled to both the detection device on the exterior, for handling in manual self-scanning procedure, and an input/output unit on the interior, for use by the operator. The monitored person handles the detection device, which transmits at least a first type handling signal, and at least a second type recognition signal to the monitoring unit. The operator rates the monitored person and transmits a third type rating signal to the monitoring unit, indicating crossing permission or crossing denial. The monitoring unit then derives an access signal from the three types of signals received from at least two sensors to allow or to deny access via the passage.

26 Claims, 1 Drawing Sheet

MONITORING ACCESS VIA A PASSAGE

BACKGROUND OF THE INVENTION

The present invention relates to crowd screening for the detection of hidden prohibited articles, such as concealed by terrorists, and more particularly, to a method and a system for monitoring access by detecting searched-for articles, such as bombs, before allowing access via the passage.

During the last decade, a large and ever-increasing number of explosive-carrying terrorists blew themselves up among random or selected victims, often killing and inflicting heavy casualties to their intended targets and to passers-by, and also causing severe material damage. Existing devices and methods for the detection of explosives carried by terrorists achieve only partial success.

Nowadays, guards for the detection of terrorists are positioned in front of the entrance to shops, restaurants, and public buildings. Evidently, access monitoring is also necessary for controlling the entrance into buses and trains, and in general, the entrance into public transportation vehicles.

Guards usually scan each monitored person by operating hand-held devices, such as metal detectors, or have people pass through a detection gate. In addition, personal belongings, such as purses and bookbags are searched through. FIG. 1 depicts the present art, in which a crowd 11 of individual persons 13 wishes to pass from an exterior side EXT to an interior side INT via a passage 15 entered in a partition 17. An operator 19, or guard 19 handling a manual device 21 is charged with the scanning of each single person 13 before allowing crossing to the interior INT, via the passage 15.

The presently used terrorist uncovering scheme is dangerous, since a terrorist most often blows himself up when believing he has been found out, to kill guards and crowds of queuing-up individuals. This practice exposes security personnel, which have to come close to a potential suicide bomber, to high risks, which might impair their effectiveness. Although U.S. patent application Ser. No. 11/026,384 by Fisher D., which is incorporated herewith in whole by reference deals with this problem, the sensors recited therein are at some distance from the monitored person.

BRIEF SUMMARY OF THE INVENTION

It is difficult to detect a terrorist amongst a crowd of individuals such as a people converging toward an entrance passage, like that of a building, or a public transportation vehicle. Even if an individual is singled out, it is still hard to distinguish if that person is a terrorist carrying weapons and/or explosives.

The problem of detection of a suicide bomber is also acute with regard to passengers boarding public transportation means, which are a prime target since people are packed inside a confined space, thereby increasing the lethality and the damage inflicted by an explosion inside the vehicle.

Using a trained dog to sniff people has limitations since the dog is able to perform continuously for one hour at most. A guard scanning people with a metal detector is the closest prior art known. The disadvantage is that the guard's life is at stake, as was sadly proven by experience.

As a solution to this problem, the access monitoring method and system compels each person to manually handle a detection device to in a self-scanning procedure. The hand-held detection device is coupled to instrumentation for checking each person before allowing access via the passage. The detection device is loaded with sensors coupled to a monitoring unit for interactive use by an operator.

The operator visually supervises the self-scanning process and receives information from sensors in the detection device, via the monitoring unit and an output device, about the adequacy with which the self-scanning procedure was performed.

Further sensors also incorporated in the detection device carry the task of sensing and detecting prohibited objects and substances possibly concealed on the passenger's body or in his luggage. Sensing results report and display the condition of a monitored person as "safe condition" or as "dangerous condition".

Finally, the operator enters his own assessment regarding the monitored person, by providing a crossing permission, or crossing denial, via an input device coupled to the monitoring unit. Should the three signals, namely adequate handling of the detection device, safe condition results, and crossing permission be received, then access for crossing through the entrance passage is allowed.

The present invention permits to use multiple types of sensors, dedicated to various purposes, and is not limited to one kind of sensors, such as metal detectors only. In contrast with a dog, the system is operative as long as desired, and is not limited to one hour Furthermore, the operator is remote from the monitored person, thus remote from immediate danger should the monitored person be a suicide bomber.

Moreover, the present invention allows the detection of a terrorist before access to the interior of a protected area, thus preventing an explosion inside a confined space.

It is an object of the present invention to provide a method and a system for monitoring access of a person from an exterior to an interior of a partition via a passage having an openable closed opening by using a detection device and the supervision of an operator. A monitoring unit is coupled in operative association with the detection device, which is disposed on the exterior for handling in a manual self-scanning procedure, and also with an input/output unit, which is disposed on the interior for use by the operator. The person desirous of access is required to manually handle the detection device in self scanning procedure, which when operated, transmits at least one first type handling signal, and at least one second type recognition signal to the monitoring unit. Then, the operator is required to rate the person on the exterior, and to transmit a third type rating signal to the monitoring unit via the input/output unit, indicating either one of both crossing permission and crossing denial. Next, the monitoring unit is operated for processing the handling signal to derive indication of either one of both adequate and inadequate handling of the detection device, and for processing the recognition signal to derive a condition selected from the group of conditions consisting of safe condition, uncertain condition, and dangerous condition. It is now to the monitoring unit to derive either one of both a positive and a negative access signal. Finally, the openable closed opening is opened for access when there is derived a positive access signal indicating adequate detection, safe condition, and crossing permission, whereby the person is allowed access via the passage from the exterior to the interior of the partition. It is noted that the openable closed opening remains closed when the monitoring unit derives a negative access signal different from the positive access signal. Furthermore, opening of the openable closed opening following a positive access signal is operated by command received from either one of both the operator and the monitoring unit. Moreover, the operator visually supervises the manual self-scanning procedure.

It is another object of the present invention to provide a method and a system wherein the detection device has at least a first sensor configured to derive the at least one first type handling signal, and a second sensor configured to derive the at least one second type recognition signal.

It is still another object of the present invention to provide a method and a system wherein the manual self-scanning procedure of a person is repeated when a previous manual self-scanning procedure returned either one of both and both an inadequate handling signal and an uncertain condition.

It is yet another object of the present invention to provide a method and a system wherein the monitoring unit is further coupled in operative association with at least one communication device for bi-directional communication between the operator and the exterior side of the partition, and the at least one communication devices is selected alone and in combination from the group of devices consisting of audio and of video communication devices.

It is further another object of the present invention to provide a method and a system wherein i sets of sensors with i=[1, 2, . . . , n], are coupled in operative association with the monitoring unit, each set i having a finite number of sensors with at least one sensor, and each sensor deriving at least one signal, a first set i=1 of sensors has at least one first type handling sensor which derives at least one handling signal, a second set i=2 of sensors has at least one second type recognition sensor which derives at least one recognition signal, and the monitoring unit derives either one of both a negative and a positive access signal from the i sets of sensors and from the rating signal transmitted by the operator.

It is still a further object of the present invention to provide a method and a system wherein a second type recognition signal is derived from at least one set of sensors for recognizing materials selected from the group of materials consisting of metals and of explosives. Likewise, a second type recognition signal is derived from at least one set of sensors for recognizing materials selected from the group of noxious and warfare materials consisting of chemical, biological, radiological, and nuclear materials. In the same manner, a second type recognition signal is derived from at least one set of sensors for recognizing parameters selected alone and in combination from the group of parameters consisting of physical and physiological parameters. If desired, at least one second type sensor is supported on an exterior surface of the partition.

It is moreover a further object of the present invention to provide a method and a system wherein a dedicated data fusion software application computer program is operated on the monitoring unit to derive the access signal, according to at least one level of risk p, with p=[1, 2, . . . , q]. In addition, at least one dedicated data fusion software application computer program is operated on signals derived from each set i of sensors according to at least one level of risk t, with t=[1, 2, . . . , r].

BRIEF DESCRIPTION OF DRAWINGS

In order to better understand and more fully appreciate the invention and to see how the same may be carried out in practice, a preferred embodiment will now be described, by way of non-limiting example only, with reference to the accompanying drawing in which.

DETAILED DESCRIPTION OF THE INVENTION

Figure 1:
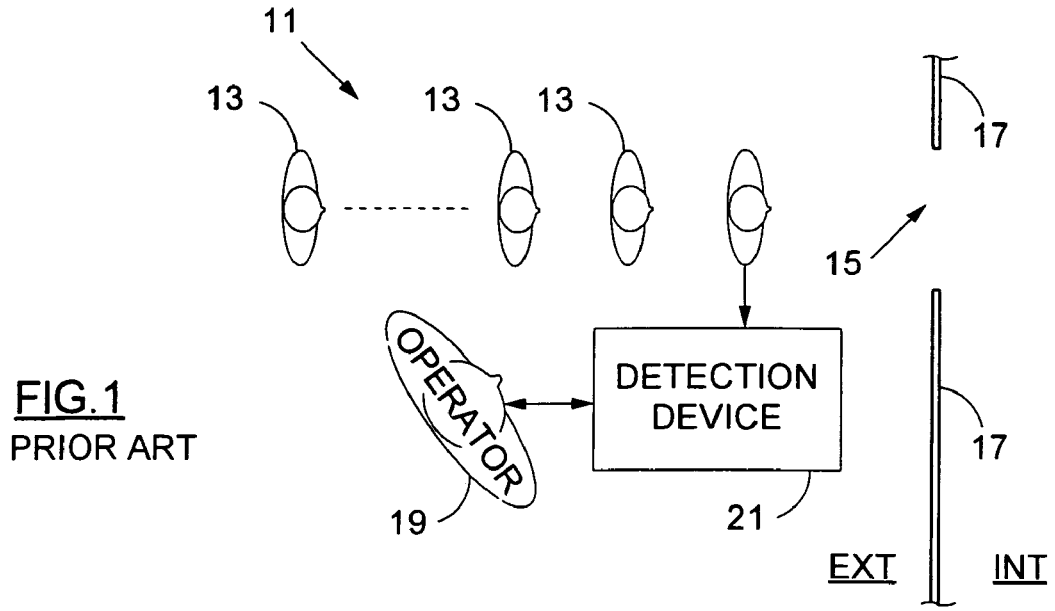
FIG.1 PRIOR ART
FIG. 1 is a diagram depicting the prior art.
Figure 2:
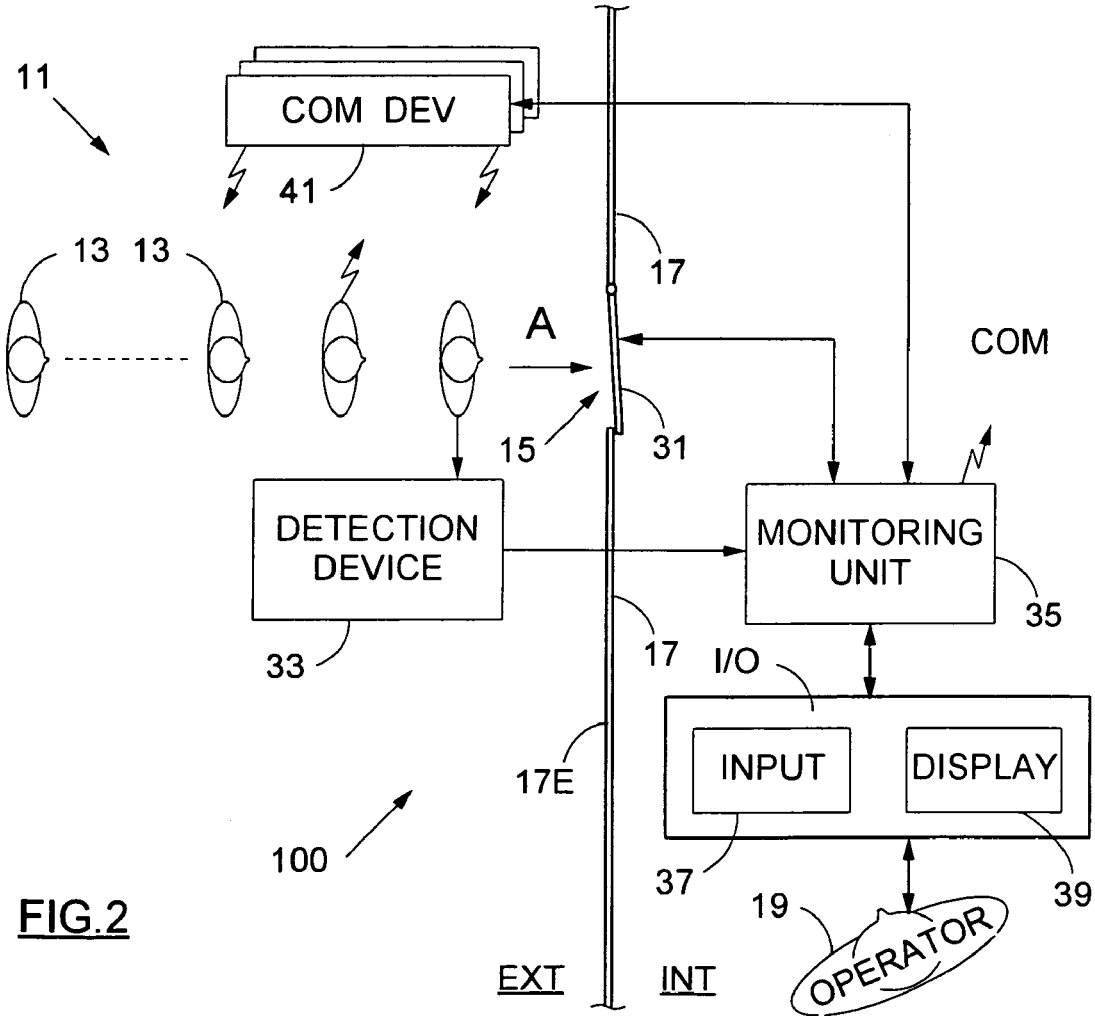
FIG. 2 is a diagram illustrating the present invention.

With reference to FIG. 2, there is shown a diagram illustrating the principles of operation of a system for monitoring access, and a method implementing the system, designated as embodiment 100. A crowd 11 of individual persons 13 wishes to access, in the direction shown by arrow A, from an exterior side EXT to an interior side INT via a passage 15 entered in a partition 17. The passage 15 is provided with a usually closed but openable opening 31, remotely controlled to open and permit passage, or to remain locked and physically block any possibility of passage. A detection device 33 disposed on the exterior EXT side of the partition 17 is made available in turn to each one of the individual persons 13. The detection device 33 is coupled in operative association with a computer processor-driven monitoring unit 35, having a memory and means for reading and operating software application computer programs, able to manage and command operation of the access monitoring system.

The detection device 33 incorporates at least two sensors. The various sensors are not shown in the different FIGS., for the sake of simplicity. A sensor is a device designed to respond to a physical stimulus and transmit a resulting signal or impulse for interpretation or measurement, or for operating a control. A sensor may thus report or measure a physical, chemical, or physiological condition. For example, a sensor is operative for detecting metals, or for detecting explosives.

Sometimes a rather voluminous piece of equipment having a probe or sensing element is also called a sensor. In such cases only the probe or sensing element is regarded as being the sensor, while the rest of the equipment is considered as being a portion of the monitoring unit 35. For example, a sampling probe for the recognition of chemical materials, such as an air sampler, pertaining to a gas or air sampler, often also denominated as a "sniffer", is considered as being the sensor while the chemical processing and recognition equipment itself is disposed in the monitoring unit 35.

An input/output unit I/O, for example with an input device 37 and a display 39, are also coupled in operative association with the monitoring unit 35 to allow the operator 19 to, respectively, enter commands and data, and receive output data derived from the monitoring unit 35, as well as data received from other systems, local and/or remote. Also coupled in operative association to the monitoring unit 35 are one or more communication devices 41, such as a public address system operating one or more loudspeakers not shown in the FIGS., and/or warning devices 41 for providing unidirectional or bi-directional communication with the persons 13 on the exterior EXT, or to the interior INT, or to both. Such communication device(s) 41 are audio and/or video devices.

Furthermore, a bi-directional communication link COM allows transmission of information to and from the monitoring unit 35, for communication with computer processing units, databases, and networks. The operator 19 may use the input/output unit I/O, e.g. to call for help from law enforcement entities or from rescue forces. Moreover, the communication link COM permits to receive commands and data from other local or remote outside stations, for example to communicate warnings and instructions to the operator 19, to select desired sensors as described below, or to otherwise manage and control the operation of the system configured as embodiment 100.

Persons 13 lining up outside the partition 17, thus on the exterior side EXT, and wishing to enter into the interior INT, have to handle the detection device 33 in a self-scanning procedure, which means, scan the surface of their bodies with the detection device 33. Since people who wish to avoid control may try to foil the performance of the detection device 33, it is necessary to ascertain adequate handling and proper self-scanning. To that end, the detection device 33 is provided with at least one first-type of sensor(s), or handling adequacy sensor(s), so that when the detection device 33 is manually handled in self-scanning mode, at least one first handling signal is derived to indicate adequate handling or inadequate handling of the detection device.

A typical handling sensor is as a micro-switch, which has to remain depressed against the body of the scanned person 13 during the self-scanning procedure. Other examples are an optical sensor, or a proximity sensor. Still another handling sensor is possibly indicative of the body-area actually scanned. The detection device 33 may support a plurality, or a set of handling sensors.

When operated, the detection device 33 forwards a first handling signal to the monitoring unit 35, which responds by providing feedback to the operator 19, such as by activating an appropriate notification on the display 39. The detection device 33 is also handled to scan the belongings pertaining to any of the persons 13. Likewise, children and babies are also checked, and so is luggage, such as a suitcases, as well as bags, and purses.

The first handling signal is processed by the monitoring unit 35 to return an adequate or inadequate handling signal, irrelevantly of the type or of the number of handling sensors actually in use. It is noted that one single inadequate result amongst other adequate signals may suffice to deny access, thus to bar the person 13 from crossing to the interior INT, by preventing the opening of the closed opening 31. However, a software computer program running on the monitoring unit 35, described hereinbelow, may also be used and reach algorithm-driven decisions as to under what handling signal results to open the openable closed opening 31.

The detection device 33 incorporates at least one second type of sensor(s), or recognition sensor(s) for recognizing a substance or a condition, so that when the detection device 33 is manually handled in self-scanning mode, at least one type recognition signal is derived to indicate a condition as being safe, or uncertain, or dangerous.

Examples of recognition sensors are a sensor for detecting metals, indicating the possible presence of a weapon, a sensor for detecting explosives, hinting at a concealed bomb, a sensor for recognizing a physiological condition, indicating stress, a sensor for detecting drugs a sensor for detecting unconventional warfare agents, and more. Unconventional warfare agents count, for example, noxious and warfare chemical, biological, radiological, and nuclear materials and substances. The term material refers also to the substance itself in its various physical forms, such as solid, liquid or gas.

When a second type recognition signal is derived, then a response is reported to the monitoring unit 35 and an output is provided to the input/output unit I/O, for example, shown on the display 39 to the operator 19.

The detection device 33 may carry one or more sensors of each one the first and the second type, and is possibly loaded with a plurality of sensors, but should at least have one handling sensor and one recognition sensor. Preferably, the detection device 33 is equipped with more sensors, for better reliability.

The detection device 33 is configured to be hand-held, such as a wand, and loaded with at least two sensors. Since the detection device 33 is hand-held, thus gripped by a handle, physiological sensors, such as a pressure sensor, or a sweat sensor, may be incorporated in the handle, not shown in the FIGS., for transmission of derived recognition signal results to the monitoring unit 35, and possibly, to the input/output unit I/O, for display to the operator 19.

In practice, the detection device 33 may have a set of one or more handling sensors, and one or more sets of recognition sensors. Each set of recognition sensors may have one or more sensors, dedicated to a specific task, such as for the discovery of metals, explosives, physiological conditions, and the like.

The detection device 33 may operate either with all the sensors supported therein, or only with selected sensors. The selection of the sensors being operative is commanded by the operator 19 via the input/output unit I/O, or by order received via the communication link COM.

It is noted that more recognition sensors disposed on the exterior side surface 17E on the exterior EXT of the partition 17 may operate in association with the recognition sensors supported by the detection device 31. For the sake of simplicity of the description, such partition-disposed recognition sensors are regarded as being supported by the detection device.

The second type recognition signal is processed by the monitoring unit 35 to return a "safe condition", an "uncertain condition", or a "dangerous condition", irrelevantly of the type or of the number of sensors actually in use. It is noted that one single "dangerous condition" result amongst other "safe condition" results may suffice to deny access, thus to bar the person 13 from crossing to the interior INT, by preventing the opening of the closed opening 31. However, a software computer program running on the monitoring unit 35, described hereinbelow, may also be used and reach algorithm-driven decisions as to under what recognition signal results to open the openable closed opening 31.

The passage 15 is closed by the openable closed opening 31, or closed doorway 31, in the sense that crossing via the passage 15 requires the opening of a closed locked door, or other physical barrier. As well known to the art, such a barrier is possibly implemented as a one-way door, a turnstile and a door, two consecutive doors one behind the other, and the like. It is noted that whatever kind of barrier is selected for the openable closed opening 31, that barrier is always disposed on the exterior side EXT of the partition 17, to always keep a person 13 being monitored, on the exterior side.

The openable closed opening 31 is operated under control of the monitoring unit 35, and under command of a software application computer program run by the monitoring unit 35, or manually commanded by the operator 19, or operated by remote command via the communication link COM. Normally, the openable closed opening 31 is locked close, but is openable when predetermined conditions are met. For example, one may require that opening the openable closed opening 31 and authorizing a person 13 to cross to the interior INT, is to be allowed only after the monitoring unit 35 receives at least three different positive signals: a first type handling signal indicating adequate self-scanning handling of the detection device, a second type recognition signal indicating a safe condition result, and a third type rating signal indicating a crossing permission approval entered by the operator 19 via the input/output unit I/O. It is the monitoring unit 35 that receives the three types of signals for processing and derivation of either a positive or a negative access signal. Other schemes for allowing the opening the openable closed opening 31 are possibly implemented by use of algorithm-based decisions.

The operator 19, who is remote from the openable closed opening 31, visually supervises the self-scanning procedure or process performed on the exterior EXT by the person 13 desirous to cross to the interior INT. Visual supervision is achieved via a window appropriately entered into the partition 17, or with mirrors, or via the communication device(s) 41, such as by closed-circuit TV. The operator 19 controls the access monitoring system by interacting with the monitoring unit 35 via the input/output unit I/O, such as via the input device 37 and the display 39. If desired, the input device 37 and the display 39 are replaced by a touch-screen for input and output of commands and data.

When the monitoring unit 35 derives a positive access signal, then it becomes possible to open the openable closed opening 31. The opening itself is achieved after delivery of either a manual command of the operator 19, or automatically, by a command from the monitoring unit 35. It is not possible to open the openable closed opening 31 when the monitoring unit 3 5 derives a negative access signal.

The input/output unit I/O allows the operator 19 not only to command the openable closed opening 31 and to enter crossing permission and crossing denial commands, but also to operate warning and alarm systems. Should a recognition signal result report a dangerous condition, and be displayed as such, then the operator 19 may sound warnings or give alarm via the communication device(s) 41 coupled to the monitoring unit 35. Warning and alarm are emitted by the communication device(s) 41, selectively on the exterior EXT only, on the interior INT only, or on both sides of the partition 17. Moreover, the operator 19 may use the communication link COM to send for help or receive instructions. Likewise, warning lights with a color code may serve the same purpose, but silently, or may operate in parallel to loudspeakers.

In general terms, the access monitoring method and system 100 operate with at least one first type handling sensor for deriving a first handling signal, and with at least one recognition sensor for deriving a second type recognition signal. The detection device 33 supports one handling sensor, or one set of handling sensors, out of which at least one handling sensor is operative, to derive a first handling signal.

The detection device 33, also supports at least one recognition sensor, or at least one set of recognition sensors out of which at least one recognition sensor is operative, to derive a second type recognition signal. As described hereinabove, one or more recognition sensors disposed on the exterior side surface 17E of the partition 17 may operate in association with the recognition sensors supported by the detection device 31, all recognition sensors being regarded as supported by detection device 31.

The access monitoring system may thus have i sets of sensors with i=[1, 2, . . . n], with each sensor out of the i sets being coupled in operative association to the monitoring unit 35. Each set i of sensors may has a finite number of sensors with at least one sensor, and each sensor providing at least one signal. There is at least one set of first type handling sensors and at least one set of second type recognition sensors.

For example, with i=1, a first set of a first type of handling sensors having a finite number of sensors has at least one handling sensor for deriving at least one first handling signal, which is processed by the monitoring unit 35 to derive indication of either one of both adequate and inadequate handling of the detection device by the person 13. If desired, a data fusion software application program running on the monitoring unit 35 is operated on the set i=1 to derive a set output result according to various chosen risk levels p, with p=[1, 2, . . . , q].

Likewise, for example, with i=2, a second set of sensors, or first set of a second type of recognition sensors, has at least one handling sensor for deriving at least one second type recognition signal, which is processed by the monitoring unit 35 to derive an indicated condition regarding the scanned person 13, as being a safe condition, or an uncertain condition, or a dangerous condition. If desired, a data fusion software application program running on the monitoring unit 35 is operated on the set i=2 to derive a set i output result according to various chosen risk levels t, with t=[1, 2, . . . , r].

In the same manner as described hereinabove, each set of second type sensors is dedicated to a specific recognition task. For example, one set for recognizing metals, another for recognizing explosives, a further set for recognizing unconventional warfare agents, still another set for recognizing drugs, and so on. There are thus possibly many sets of second type recognition sensors, all providing second type recognition signals. If desired, additional sensors and additional sets of sensors are supported for the sake of redundancy and reliability.

Operation of the access monitoring system of embodiment 100 is now described with reference to only one handling sensor and only one recognition sensor, to keep the description simple. Persons 13 out of a line 11 of persons, wishing to cross through the passage 15, line-up on the exterior EXT of the partition 17. The passage 15 is typically the entrance to a building, a facility, a room, or a vehicle such as a bus or a train. The first person 13 in line is expected to pick-up the detection device 33 available on the exterior EXT, disposed for example on the exterior side of the partition 17, and to begin a self-scanning procedure. When picked-up, the detection device 33 informs the operator 19, via the monitoring unit 35 and the input/output unit I/O, that the access monitoring process is operated. Instructions for handling the detection device 33 are listed on the exterior side EXT, or voiced by the detection device 33 itself, or provided by the operator 19, via the communication device(s) 41.

The operator 19 now turns his attention to the person 13 handling the detection device 33, and watches the output on the input/output unit I/O, e.g. on the display 19. All is well if the handling signal indicating adequate handling of the detection device 33 is received. Else, if an inadequate handling signal, or an uncertain recognition signal is derived, then the operator 19 may use the communication device(s) 41, by use of the public address system disposed on the exterior side EXT, to request a more careful repeated manual self-scanning handling procedure of the detection device 33. Evidently, another person 13 may come to help and remedy the situation, if the failure is due to clumsy handling of the detection device 33. Should the person 13 not succeed or not want to comply, then access is denied.

After the handling signal proves that successful self-scanning is achieved, then the second type recognition signal indicating a safe condition is scrutinized. Should the recognition signal not be derived as a safe condition result, then access is denied. At this moment, with the openable closed opening 31 still blocked, the operator 19, or the software application computer program, may chose to give warning, sound an alarm, and communicate the situation, via the communication device(s) 41, for example, by use of loudspeakers or warning lights if available, and/or via the communication link COM. When the openable closed opening 31 pertains to a vehicle, say a bus, then the driver, who is possibly also the operator 19, may drive away to escape a potentially dangerous situation.

Should the handling signal and the recognition signal report, respectively, adequate handling and a safe condition, then it is to the operator 19 to decide whether to enter the third rating signal indicating his crossing permission. In the positive, the operator 19 transmits a crossing permission to the monitoring unit 35.

In turn, the monitoring unit 35 processes the three types of signals, namely the handling, the recognition, and the crossing signals, to derive either a positive or a negative access signal. For a positive access signal crossing is granted by unlocking, thus opening the closed opening 31, in response to a command provided either by the software computer program, or as a manually entered command delivered by the operator 19. It is pointed out that the openable closed opening 31 is always a one-way physical passage-preventing barrier, preventing brute-force forceful entrance via the passage 15.

It is noted that the open or closed condition of the openable closed opening 31 is continuously reported to the operator 19 by the input/output unit I/O. The operator 19 always has the ability to override commands received from and via the monitoring 35, to close the openable closed opening 31 at will.

For access passages 15 pertaining to vehicles, a door is necessary for safety reasons and for the protection of the passengers from the elements. The door itself is a simple, double, rotating, or other door, all doors being well known to the art and not requiring further details, but always disposed on the exterior side EXT of the partition 17.

When a partition 17 has a first passage 15 equipped with a monitoring access system, and also has other additional passages 15 in the same partition, then measures have to be taken to prevent bypass of the first passage 15 for entrance via any of the other additional passages. Either all the other additional passages are also equipped with the monitoring access system, or they are configured as one-way exit only passages, to prevent entrance therethrough. In the case of a bus with two doors, one entrance door is equipped with the monitoring access system and the second door is a one-way exit door. The operator 19 may also supervises the exit door, say via a set of mirrors, or by closed-loop TV.

It will be appreciated by persons skilled in the art, that the present invention is not limited to what has been particularly shown and described hereinabove. For example, the detection device may be implemented in different configurations, according to the sensors incorporated therein. In addition, the task of the operator may be replaced by a computerized vision system, for the monitoring access system to become free of human intervention. Rather, the scope of the present invention is defined by the appended claims and includes both combinations and sub-combinations of the various features described hereinabove as well as variations and modifications thereof which would occur to persons skilled in the art upon reading the foregoing description.

The invention claimed is:

1. A method for monitoring access of a person from an exterior to an interior of a partition via a passage having an openable closed opening, the method using a detection device and supervision of an operator, comprising the steps of:

coupling a monitoring unit in operative association with the detection device, which is disposed on the exterior for handling in a manual self-scanning procedure, coupling the monitoring unit in operative association with an input/output unit, which is disposed on the interior for use by the operator, requiring the person desirous of access to handle the detection device, which when operated, transmits at least one first type handling signal, and at least one second type recognition signal to the monitoring unit, requiring the operator to rate the person on the exterior, and to transmit a third type rating signal to the monitoring unit via the input/output unit, indicating either one of both crossing permission and crossing denial, operating the monitoring unit for:

processing the handling signal to derive indication of either one of both adequate and inadequate handling of the detection device, processing the recognition signal to derive a condition selected from the group of conditions consisting of safe condition, uncertain condition, and dangerous condition, deriving either one of both a positive and a negative access signal, and opening the openable closed opening for access when there is derived a positive access signal indicating:

a. adequate detection, b. safe condition, and c. crossing permission, whereby the person is allowed access via the passage from the exterior to the interior of the partition.

2. The method according to claim 1, wherein:

the detection device has at least a first sensor configured to derive the at least one first type handling signal, and a second sensor configured to derive the at least one second type recognition signal.

3. The method according to claim 1, wherein:

the openable closed opening remains closed when the monitoring unit derives a negative access signal different from the positive access signal.

4. The method according to claim 1 wherein the manual self-scanning procedure of a person is repeated when:

a previous manual self-scanning procedure returned at least either one of both an inadequate handling signal and an uncertain condition.

5. The method according to claim 1, wherein:

opening of the openable closed opening following a positive access signal is operated by command received from either one of both the operator and the monitoring unit.

6. The method according to claim 1, wherein:

the monitoring unit is further coupled in operative association with at least one communication device for bi-directional communication between the operator and the exterior side of the partition, and the at least one communication device is selected alone and in combination from the group of devices consisting of audio and of video communication devices.

7. The method according to claim 1, wherein:

the operator visually supervises the manual self-scanning procedure.

8. The method according to claim 1, wherein:

i sets of sensors, with i=[1, 2, . . . , n], are coupled in operative association with the monitoring unit, each set i having a finite number of sensors with at least one sensor, and each sensor deriving at least one signal, a first set i=1 of sensors has at least one first type handling sensor which derives at least one handling signal, a second set i=2 of sensors has at least one second type recognition sensor which derives at least one recognition signal, and the monitoring unit derives either one of both a negative and a positive access signal from the i sets of sensors and from the rating signal transmitted by the operator.

9. The method according to claim 8, wherein:

a second type recognition signal is derived from at least one set of sensors for recognizing materials selected from the group of materials consisting of metals and of explosives.

10. The method according to claim 8, wherein:

a second type recognition signal is derived from at least one set of sensors for recognizing materials selected from the group of noxious and warfare materials consisting of chemical, biological, radiological, and nuclear materials.

11. The method according to claim 8, wherein:

a second type recognition signal is derived from at least one set of sensors for recognizing parameters selected alone and in combination from the group of parameters consisting of physical and physiological parameters.

12. The method according to claim 8, wherein:

at least one second type sensor is supported on an exterior surface of the partition.

13. The method according to claim 8, wherein:

a dedicated data fusion software application computer program is operated on the monitoring unit to derive the access signal, according to at least one level of risk p, with p=[1, 2, . . . , p].

14. The method according to claim 13, wherein:

at least one dedicated data fusion software application computer program is operated on signals derived from each set i of sensors, according to at least one level of risk t, with t=[1, 2, . . . , r].

15. A system for monitoring access of a person seeking to cross from an exterior to an interior of a partition via a passage having an openable closed opening, the system having a monitoring unit and an operator for supervising access, comprising:

a detection device coupled in operative association with the monitoring unit and handled by the person on the exterior in manual self-scanning procedure for deriving at least one first type handling signal and at least one second type recognition signal for transmission to the monitoring unit, an input/output unit disposed on the interior for use by the operator to rate the person on the exterior, and coupled in operative association with the monitoring unit for transmission thereto of a third type rating signal indicating either one of both crossing permission and crossing denial, i sets of sensors, with i=[1, 2, . . . , n], coupled in operative association with the monitoring unit, each set i having a finite number of sensors with at least one sensor, and each sensor deriving at least one signal, a first set i=1 of sensors having at least one first type handling sensor to derive at least one handling signal for processing by the monitoring unit to derive indication of either one of both adequate and inadequate handling of the detection device, second sets i>1 of sensors having at least one second type recognition sensor to derive at least one recognition signal for processing by the monitoring unit to derive indication of a condition selected from the group of conditions consisting of safe, uncertain, and dangerous condition, the monitoring unit being operated to derive either one of both a positive and a negative access signal from the at least one first and second type signals and from the third type signal, and the openable closed opening being opened for access when there is derived a positive access signal indicating:

a. adequate detection, b. safe condition, and c. crossing permission, whereby the person is allowed access to cross via the passage from the exterior to the interior of the partition.

16. The system according to claim 15, wherein:

the openable closed opening remains closed when the monitoring unit derives a negative access signal different from the positive access signal.

17. The system according to claim 15, wherein:

the manual self-scanning procedure of a person is repeated when a previous manual self-scanning procedure returned at least either one of both an inadequate handling signal and an uncertain condition.

18. The system according to claim 15, wherein:

opening of the openable closed opening following a positive access signal is operated by command received from either one of both the operator and the monitoring unit.

19. The system according to claim 15, wherein:

the monitoring unit is further coupled in operative association with at least one communication device for bi-directional communication between the operator and the exterior side of the partition, and the at least one communication device is selected alone and in combination from the group of devices consisting of audio and of video communication devices.

20. The system according to claim 15, wherein:

the manual self-scanning procedure is visually supervised by the operator.

21. The system according to claim 15, wherein:

a second type recognition signal is derived from at least one set of sensors for recognizing materials selected from the group of materials consisting of metals and of explosives.

22. The system according to claim 15, wherein:

a second type recognition signal is derived from at least one set of sensors for recognizing materials selected from the group of noxious and warfare materials consisting of chemical, biological, radiological, and nuclear materials.

23. The system according to claim 15, wherein:

a second type recognition signal is derived from at least one set of sensors for recognizing parameters selected alone and in combination from the group of parameters consisting of physical and physiological parameters.

24. The system according to claim 23, wherein:

at least one second type sensor is supported on an exterior surface of the partition.

25. The system according to claim 15, wherein:

a dedicated data fusion software application computer program is operated on the monitoring unit to derive the access signal, according to at least one level of risk p, with p=[1, 2, . . . , p].

26. The system according to claim 25, wherein:

at least one dedicated data fusion software application computer program is operated on signals derived from each set i of sensors, according to at least one level of risk t, with t=[1, 2, . . . , r].

* * * * *